US008707482B1

(12) United States Patent
Ramthun

(10) Patent No.: US 8,707,482 B1
(45) Date of Patent: Apr. 29, 2014

(54) FITTED COVERING FOR A MATTRESS WITH CORNER ANCHOR BANDS

(71) Applicant: Target Brands, Inc., Minneapolis, MN (US)

(72) Inventor: Laura Elena Ramthun, Farmington, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/949,751

(22) Filed: Jul. 24, 2013

Related U.S. Application Data

(60) Provisional application No. 61/837,998, filed on Jun. 21, 2013.

(51) Int. Cl.
*A47G 9/04* (2006.01)
*A47G 9/02* (2006.01)

(52) U.S. Cl.
USPC ..... 5/499; 5/497; 5/496; 5/500

(58) Field of Classification Search
USPC ..... 5/495–500
See application file for complete search history.

(56) References Cited

U.S. PATENT DOCUMENTS

| | | | | | |
|---|---|---|---|---|---|
| 1,841,410 | A | * | 1/1932 | Karr | 5/500 |
| 2,284,778 | A | * | 6/1942 | Treiber | 5/498 |
| 2,662,234 | A | * | 12/1953 | Citron | 5/497 |
| 2,791,784 | A | | 5/1957 | Tomsic | |
| 3,092,848 | A | * | 6/1963 | Gronvold | 5/495 |
| 4,662,013 | A | | 5/1987 | Harrison | |
| 4,703,530 | A | | 11/1987 | Gusman | |
| 4,768,252 | A | | 9/1988 | Ross | |
| 4,825,489 | A | * | 5/1989 | Ross | 5/497 |
| 4,912,790 | A | | 4/1990 | MacDonald | |
| 4,980,941 | A | | 1/1991 | Johnson, III | |
| 5,029,353 | A | | 7/1991 | Kimball et al. | |
| 5,263,212 | A | * | 11/1993 | Garcia | 5/496 |
| 5,479,664 | A | | 1/1996 | Hollander | |
| 5,513,403 | A | | 5/1996 | Wooten, Jr. | |
| 5,625,912 | A | | 5/1997 | McCain et al. | |
| 5,729,847 | A | | 3/1998 | Allardice | |
| 6,983,500 | B2 | | 1/2006 | Wootten | |
| 7,032,262 | B2 | | 4/2006 | Creech | |

(Continued)

OTHER PUBLICATIONS

U.S. Appl. No. 13/371,038, filed Mar. 8, 2013 (42 pages).
Wamsutta Fitted Sheet with Staymade™ Corner (admitted prior art) (1 page).
"The DreamFit™ Bed Sheet", printed from http://deepfitsheets.com/, available at least as early as Feb. 22, 2012 per http://web.archive.org (1 page).

(Continued)

*Primary Examiner* — Michael Trettel
(74) *Attorney, Agent, or Firm* — Griffiths & Seaton PLLC; JoAnn M. Seaton

(57) ABSTRACT

A fitted covering for a mattress includes a body, a peripheral elastic band, and an anchor band. The body includes an upper panel and a side skirt extending outwardly away from the upper panel. The upper panel and the side skirt are coupled to one another along a seam extending substantially entirely around an outer periphery of the upper panel. The upper panel defines at least one corner. The peripheral elastic band is coupled with and extends around the side skirt opposite the upper panel. The anchor band is elongated and defines a first end and a second end opposite the first end. The first end and the second end are positioned on opposite sides of the at least one corner such that the anchor band extends diagonally across the at least one corner, and each of the first end and the second end is secured within the seam.

24 Claims, 14 Drawing Sheets

(56) References Cited

U.S. PATENT DOCUMENTS

| | | | | |
|---|---|---|---|---|
| 7,150,055 | B2 | 12/2006 | Wootten, Jr. | |
| 7,316,039 | B2 | 1/2008 | Wootten, Jr. | |
| 7,530,124 | B1 | 5/2009 | Wootten, Jr. | |
| 7,562,404 | B2 | 7/2009 | Wootten, Jr. | |
| 7,565,707 | B2 | 7/2009 | Wootten, Jr. | |
| 7,698,758 | B2 | 4/2010 | Wootten, Jr. | |
| 8,438,679 | B2 * | 5/2013 | Wootten, Jr. | 5/482 |
| 2004/0040090 | A1 | 3/2004 | Wootten | |
| 2005/0011007 | A1 | 1/2005 | Lintner | |
| 2009/0205134 | A1 | 8/2009 | Wootten, Jr. | |

OTHER PUBLICATIONS

"Super Plush Mattress Topper", printed from www.shopdownlite.com/superplushmattresstopper-p-345.html publicly available at least as early as Jan. 20, 2012 per http://web.archive.org (2 pages).

"Euro-Luxury Natural Latex/Rubber Topper", printed from www.rawganique.com/Bed/natural-rubber-mattress-topper.htm available at least as early as Oct. 29, 2012 (3 pages).

"Anchor Band Mattress Pad", printed from http://sell.bizrice.com/selling-leads/462136/Anchor-Band-Mattress-Pad.html available at least as early as Oct. 29, 2012 (3 pages).

* cited by examiner

FITTED COVERING FOR A MATTRESS WITH CORNER ANCHOR BANDS

CROSS-REFERENCE TO RELATED APPLICATION

This is a non-provisional application claiming priority to U.S. Provisional Patent Application No. 61/837,998, filed Jun. 21, 2013, which is incorporated herein by reference.

BACKGROUND OF THE INVENTION

Fitted sheets and mattress pads are commonly used and available to accommodate various sizes of mattresses (e.g., twin, full, queen, king, and California king). Many mattress coverings are formed of one or more pieces of generally inelastic fabric formed to fit over a top surface, side surfaces, and a portion of a bottom surface of a mattress or similar structure. An elastic band extends around a lower edge or periphery of the covering under the mattress to hold the covering in place around the mattress. After being subjected to the pulling and pushing of the mattress covering on the mattress caused by typical tossing, turning, etc. that occurs on the mattress, mattress coverings often undesirably shift position on or inadvertently become removed from one or more corners of the mattress.

SUMMARY OF THE INVENTION

One aspect of the present invention relates to a fitted covering for a mattress. The fitted covering includes a body, a peripheral elastic band, and an anchor band. The body includes an upper panel and a side skirt extending away from an outer perimeter of the upper panel. The upper panel and the side skirt are coupled to one another along a seam extending substantially entirely around the outer perimeter of the upper panel. The upper panel defines at least one corner. The peripheral elastic band is coupled with and extends around the side skirt opposite the upper panel. The anchor band is elongated and defines a first end and a second end opposite the first end. The first end and the second end are positioned on opposite sides of the at least one corner such that the anchor band extends diagonally across the at least one corner, and each of the first end and the second end is secured within the seam. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
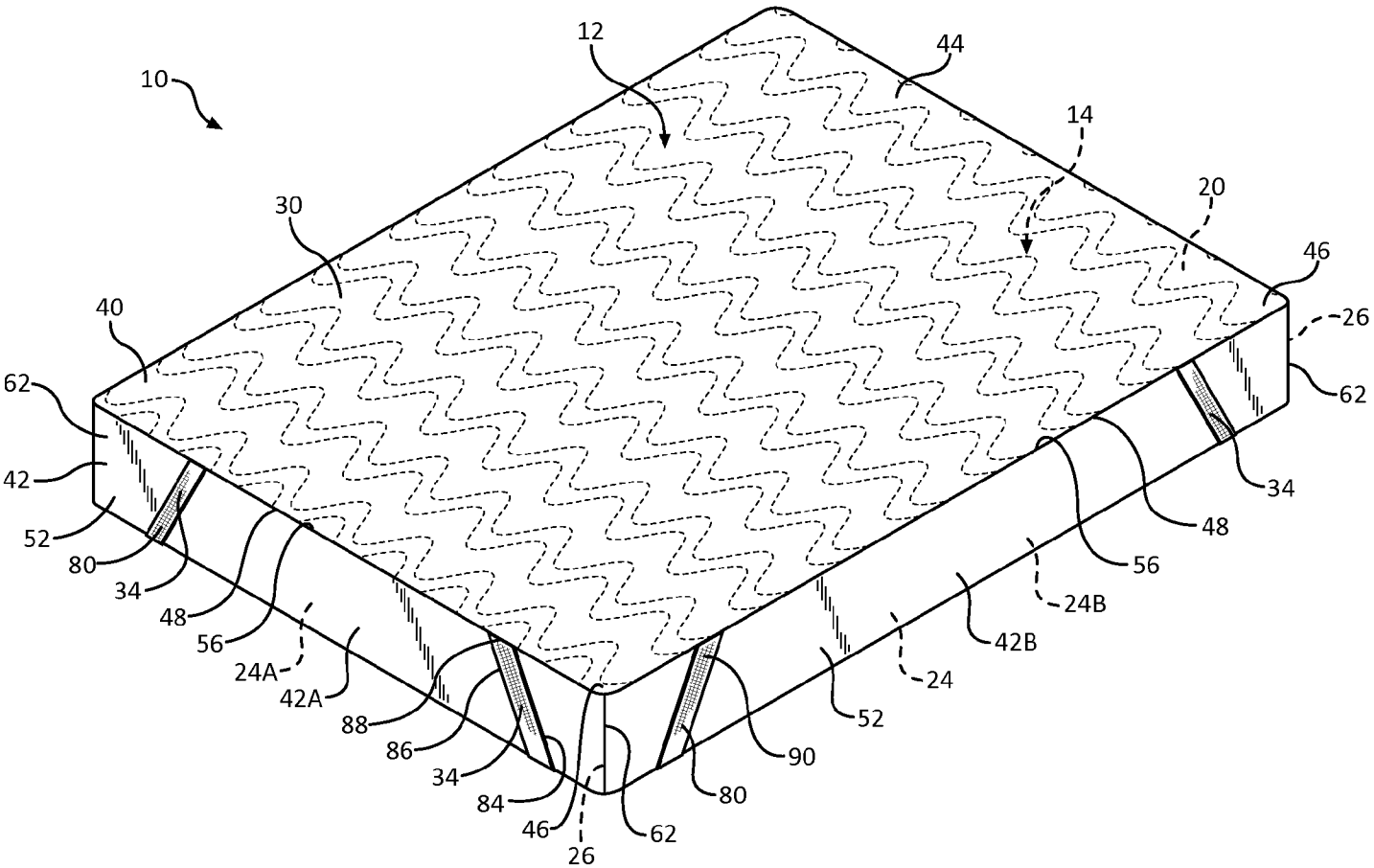
FIG. 1 is a top, front perspective view illustration of a covered mattress system including a mattress and a fitted covering, according to one embodiment of the present invention.
Figure 2:
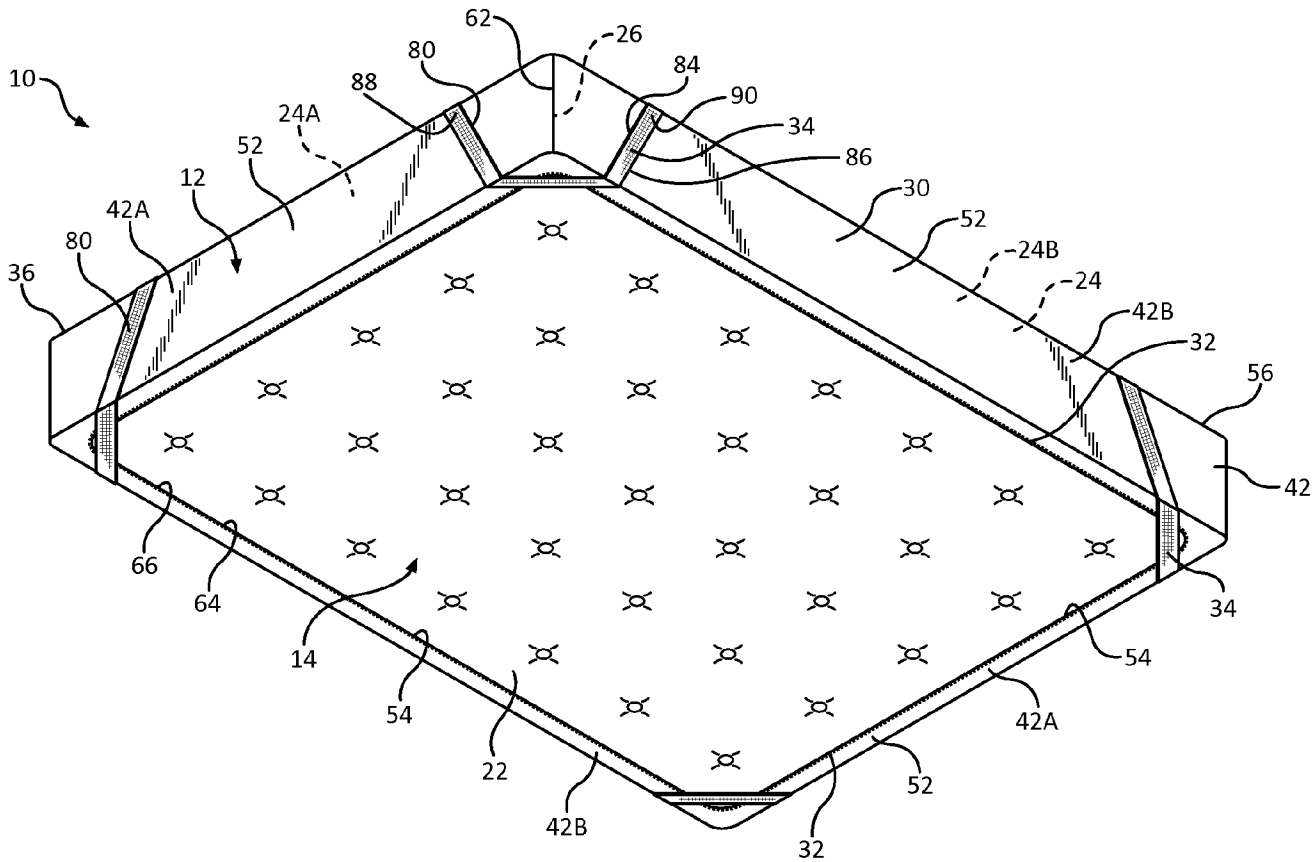
FIG. 2 is a bottom, front perspective view illustration of the covered mattress system of FIG. 1, according to one embodiment of the present invention.
Figure 3:
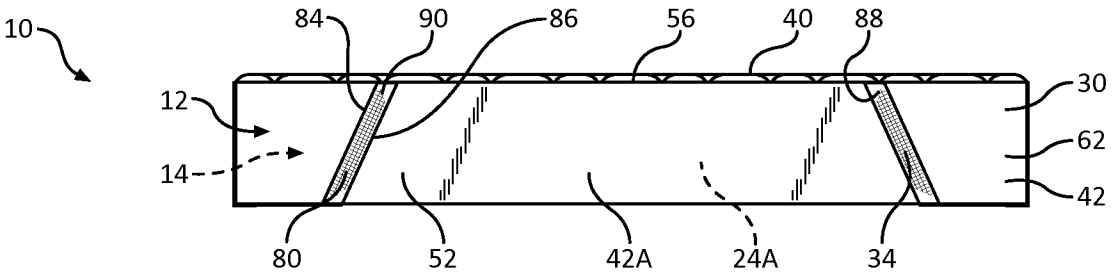
FIG. 3 is a front view illustration of the covered mattress system of FIG. 1, according to one embodiment of the present invention; the rear view being a mirror image of the front view.
Figure 4:
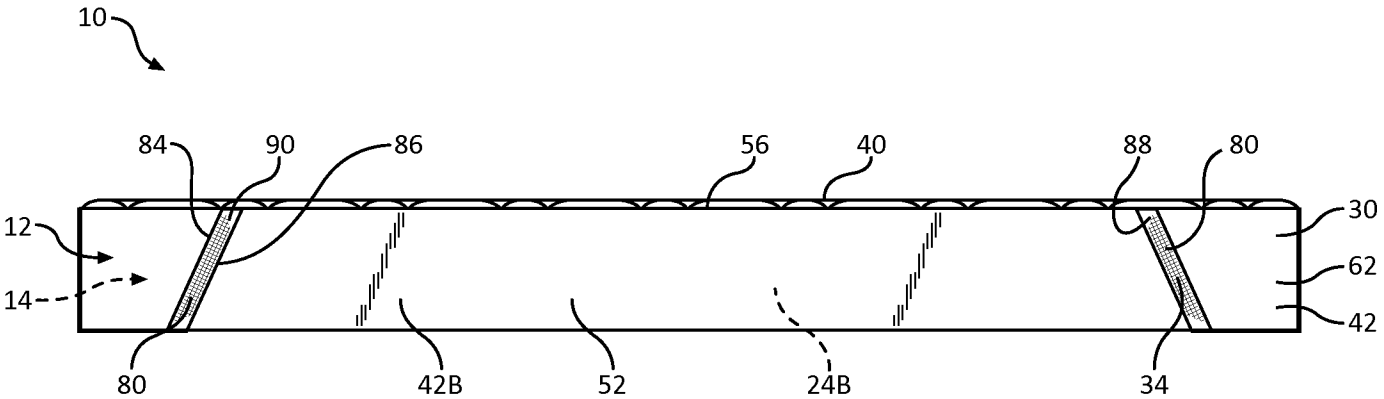
FIG. 4 is a right side view illustration of the covered mattress system of FIG. 1, according to one embodiment of the present invention; the left side view being a mirror image of the right side view.
Figure 5:
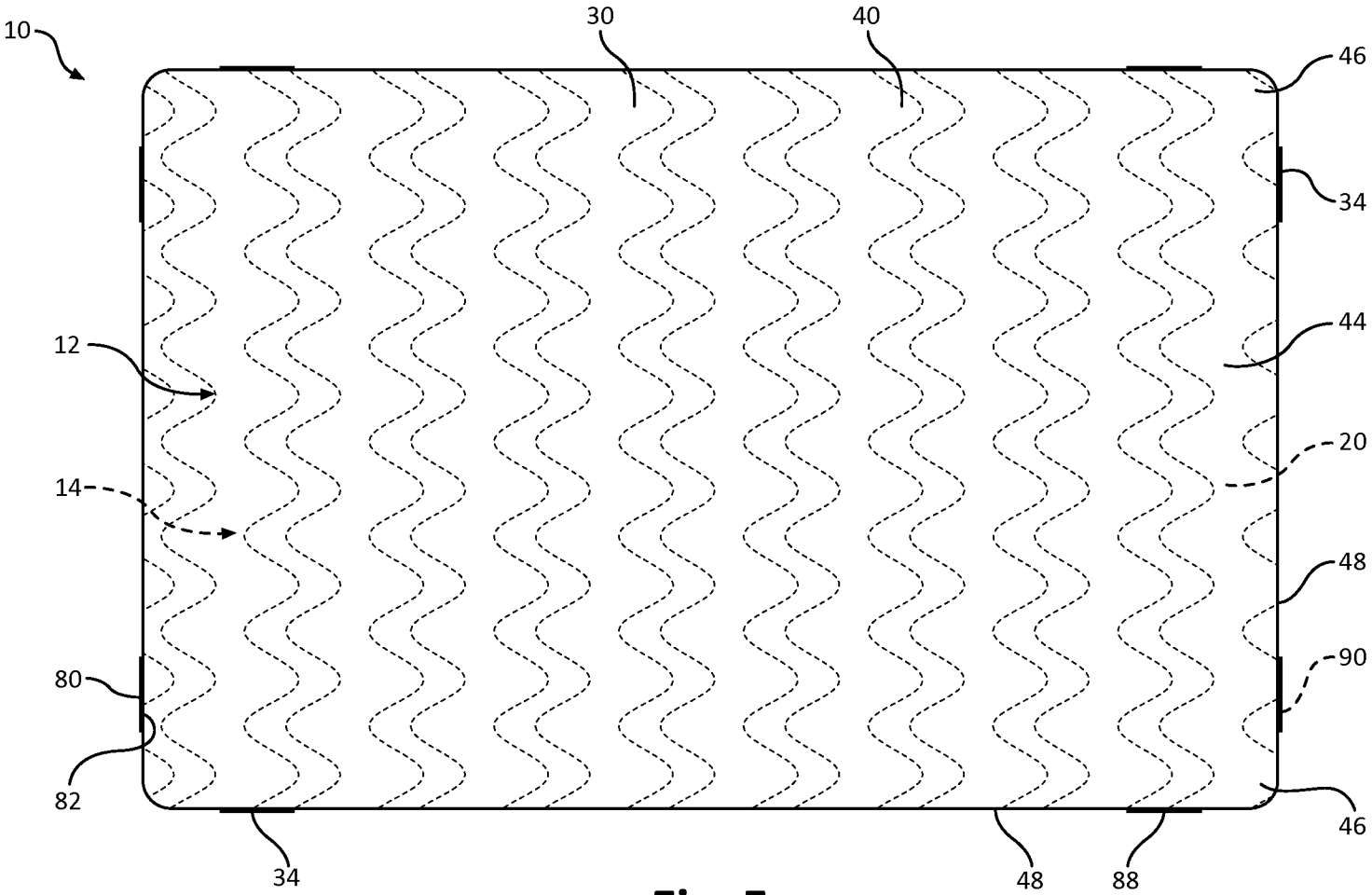
FIG. 5 is a top view illustration of the covered mattress system of FIG. 1, according to one embodiment of the present invention.
Figure 6:
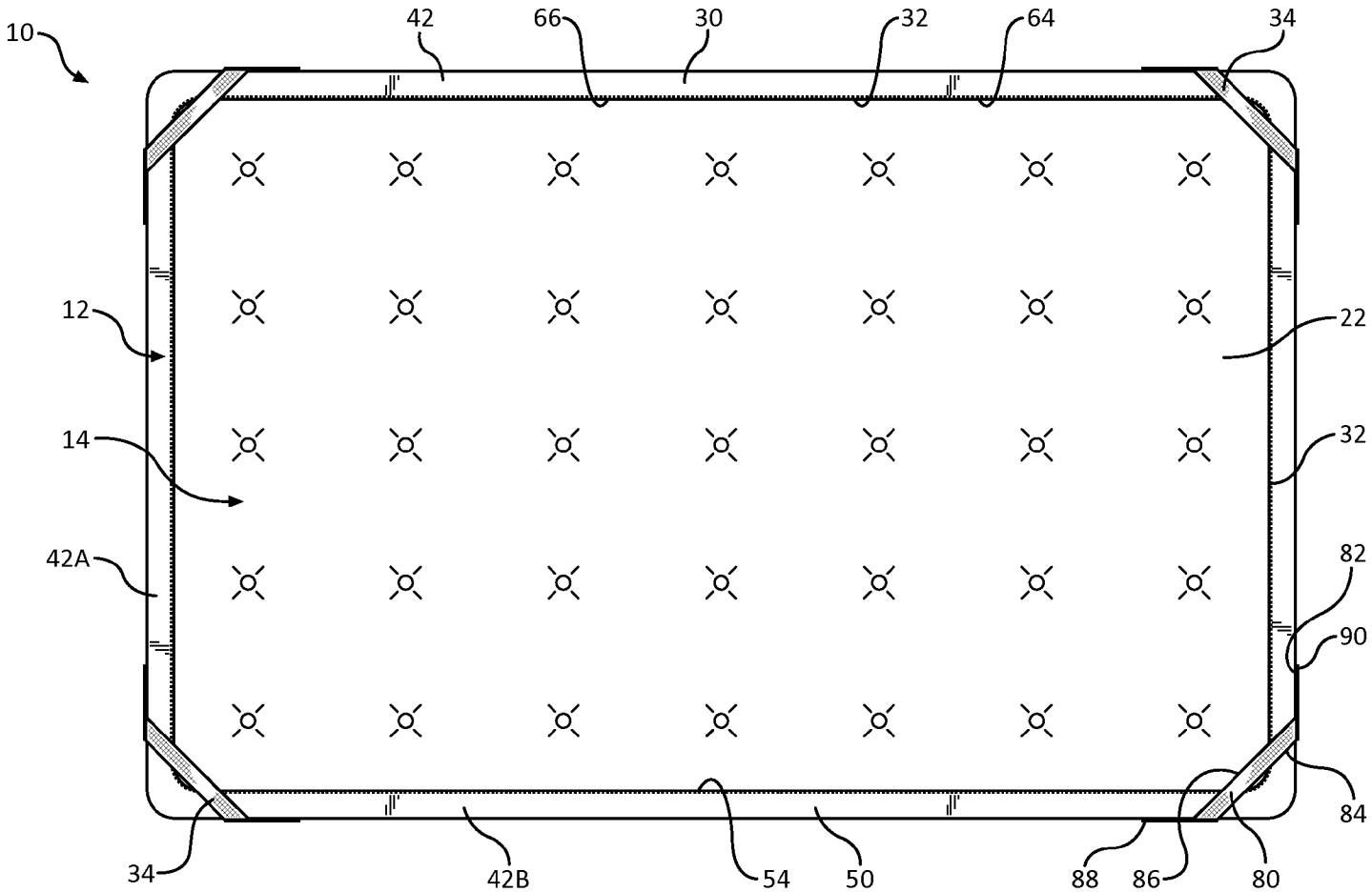
FIG. 6 is a bottom view illustration of the covered mattress system of FIG. 1, according to one embodiment of the present invention.

While fitted coverings such as fitted sheets and mattress pads for mattresses have commonly been sold in various sizes to accommodate beds of differing widths, for example, twin, double, full, queen, king, and western or California king, fitted coverings are not generally sold in various configurations based on a height or thickness of a mattress. Mattress thickness can vary greatly depending upon mattress attributes (e.g., pillow top, spring type, and other construction particulars), and for example, vary from between about 9 inches to about 20 inches or cover an even wider range of thicknesses.

Due in part to the variable thicknesses of mattresses together with general issues in maintaining mattress covering placement during the general tossing and turning that occurs on a mattress, the fitted covering described herein is configured to provide a more secure fit over mattresses than existing counterparts. More particularly, anchor bands in the form of corner elastic band strips extend from a seam line between the top panel and the side panel of the mattress covering. The anchor bands are each secured around a corner of the mattress to provide additional securement of the fitted covering to the mattress. Since each anchor band extends from edges of the top panel, it extends along and, in one example, over, the side panels of the mattress rather than just along the bottom surface of the mattress between the perimeter bottom elastic band, which further prevents undesirable shifting of the mattress covering relative to the top panel of the mattress.

Turning to the Figures, FIGS. 1-6 illustrate a covered mattress system 10 including a fitted covering 12 secured over a mattress 14. Fitted covering 12 is, in one example, one of a fitted sheet and a mattress pad configured for snug securement over mattress 14. Mattress 14, generally defines an upper face 20, a lower face 22 (FIGS. 2 and 6) opposite upper face 20, and side faces 24 extending between and substantially perpendicularly to upper face 20 and lower face 22. Notably, upper face 20 and side faces 24 of mattress 14 and various other features of mattress 14 are generally indicated through fitted covering 12 in the Figures as indicated by dashed leader lines to the respective reference numbers. In one embodiment, side faces 24 of each of first mattress 12 and second mattress 14 include two opposing lateral side faces 24A and two opposing longitudinal side faces 24B which intersect to form corners 26 transversely extending between corners of upper face 20 and lower face 22.

Fitted covering 12 is configured to selectively be disposed over mattress 14, covering upper face 20, side faces 24, and a portion of lower face 22 thereof. Fitted covering 12 includes a body 30, a peripheral elastic band 32 (FIGS. 2 and 6), and anchor bands 34. In one example, body 30 is partially or wholly formed of at least one generally inelastic material such as polyester, polyester blend, rayon, cotton, cotton blend, satin, or other suitable material. Body 30 includes a primary planar portion or upper panel 40 and side panels 42 (collectively defining a side skirt), according to one embodiment.

In one example, upper panel 40 is substantially rectangular defining an exterior face 44 and an opposite interior face (not shown) facing mattress 14 during use. Upper panel 40 further defines four corners 46 and four perimeter edges 48 each extending between a different two of four corners 46. In one embodiment, upper panel 40 is sized to cover a substantial entirety of upper face 20 of mattress 14. For example, the length and width of upper panel 40 corresponds to a standard mattress size, e.g., twin, full, queen, or western or California king. In one example, upper panel 40 is batted and quilted or otherwise formed to add cushion to mattress 14. Upper panel 40 may be formed of one or a plurality of layers for the desired effect and, in one embodiment, is formed to be one of waterproof and water resistant.

Side panels 42 are formed as four separate pieces secured to upper panel 40 along the four perimeter edges 48 of upper panel 40, in one embodiment. Side panels 42, in one embodiment, more specifically, include two opposing lateral side panels 42A and two opposing longitudinal side panels 42B. Each side panel 42 defines an interior face 50 (FIGS. 7 and 8) and an opposite or exterior face 52. Interior faces 50 are turned toward side faces 24 of mattress 14 while exterior faces 52 are directed away from mattress 14. Side panels 42 each further define a bottom edge 54 (FIGS. 2 and 6-8) and an opposite top edge 56 to be joined to one or more of perimeter edges 48 of upper panel 40. While primarily described as being formed of four separate and subsequently joined panels, in one example, side panels 42 are all formed by a single elongated strip of material sewn around an entirety of perimeter edges 48 of upper panel 40. In one example, side panels 42 are formed of a different fabric than upper panel 40 such as a cotton, polyester, or blend having more stretch than upper panel 40.

As illustrated in the figures, top edge 56 of each side panel 42 is coupled to and extends away from a substantially linear peripheral segment, e.g., one of perimeter edges 48 of upper panel 40. More specifically, top edges 56 of side panels 42 are coupled to perimeter edges via a seam 92. In one embodiment, linear, free transverse ends 60 (FIGS. 7 and 8) of adjacent side panels 42 are sewn together to form a corner seam 62 extending substantially perpendicularly to upper panel 40 when fitted covering 12 is disposed on mattress 14. When four corner seams 62 are formed, side panels 42 collectively extend substantially entirely around an outer perimeter of upper panel 40. Bottom edges 42 collectively define a closed loop binding 64 (FIGS. 2 and 6-8) opposite upper panel 40 defining an opening 66 (FIGS. 2 and 6) bound by closed loop binding 64. Closed loop binding 64 securely maintains, e.g., encompasses or is otherwise sewn or coupled to, peripheral elastic cord or band 32 to facilitate retention of fitted covering 12 on mattress 14. Peripheral elastic band 32 is formed as a closed loop (e.g., ends are positioned adjacent and/or are otherwise secured to one another) and, in one example, extends through a substantial entirety of closed loop binding 64 and around opening 66.

Anchor bands 34 are each substantially linear strips of an elastomeric material, e.g., polyester/rubber or other elastic. In one example, anchor bands 34 are each formed of pre-shrunk knit elastic with an elongation of at least about 110%, for instance, of at least about 130%, and having a width of about one inch to about two inches in width, for instance, about one and one half inches. Anchor bands 34 each define an exterior face 80, an interior face 82 opposite exterior face 80, a first longitudinal edge 84, a second longitudinal edge 86 opposite first longitudinal edge 84, a first short edge 88, and a second short edge 90.

First longitudinal edge 84 and second longitudinal edge 86 extend substantially parallel to one another. First short edge 88 and second short edge 90 each are angled outwardly (i.e., in opposite directions) from their intersection with first longitudinal edge 84 to their intersection with second longitudinal edge 86. In one embodiment, first short edge 88 and second short edge 90 each extend with an angle relative to first longitudinal edge 84 of about 135° and relative to second longitudinal edge 86 of about 45°. As a result, first longitudinal edge 84 is shorter than second longitudinal edge 86. In one example, when in a non-stretched state, each anchor band 34 is between about 17 inches and about 20 inches long, for instance, about 18.75 inches long. The length of anchor band 34 allows it to stretch to fit diagonally down side panels 42 and across a corner of lower face 22 of mattress 14.

In one embodiment, first short edge 88 and second short edge 90 are secured within seam 92 along a different one of two adjacent perimeter edges 48 of upper panel 40. More specifically, each of first short edge 88 and second short edge 90 is positioned along a different side panel 42 (i.e., one along a lateral side panel 42A and the other along an adjacent longitudinal side panel 42B). Each anchor band 34 is spaced from corner 46 a sufficient distance to prevent anchor band 34 from inadvertently slipping off of a corner 26 of mattress 14 during use. In one embodiment, each of first short edge 88 and second short edge 90 are spaced from corner 46 of upper panel 40 a distance of about 10 inches to about 14 inches, for example, a distance of about 11 inches or about 12 inches from corner 36. Placed and secured in the above-described manner, during use upper panel 40 is placed on upper face 20 of mattress 14 with exterior face 44 turned upwardly away from mattress 14. Side panels 42 are each placed to extend over a different one of side faces 24 and over a perimeter portion of lower face 22 held at least partially taught by peripheral elastic band 32 below mattress 14.

Each anchor band 34, e.g., each of four anchor bands 34, is stretched to extend from seam 92 over one of side panels 42, e.g., one of lateral side panels 42A or longitudinal side panels 42B, diagonally across a different corner of mattress 14 along lower face 42 of mattress 14, and up an adjacent one of side panels 42 to a different point on seam 92. Use of the relatively thick elastic as anchor band 34 as compared to the thinner elastic of peripheral elastic band 32 provides a robust securement of fitted covering 12 to mattress 14. Unlike other fitted coverings known in the art that include elastic bands diagonally between two portions of closed loop binding 64, fitted covering 12 of the current innovation includes anchor band 34 extending down along side panels 42 and, thereby, functioning to more securely hold upper panel 40 aligned with upper face 20 of mattress 14 regardless of the height of mattress 14. This configuration decreases shifting and movement of fitted covering 12 relative to mattress 14 even after tossing, turning, and other movement of users of mattress 14 laying on fitted covering 12. Anchor bands 34 further hold side panels 42 tight over side panels 24 of mattress 14.

Figure 7:
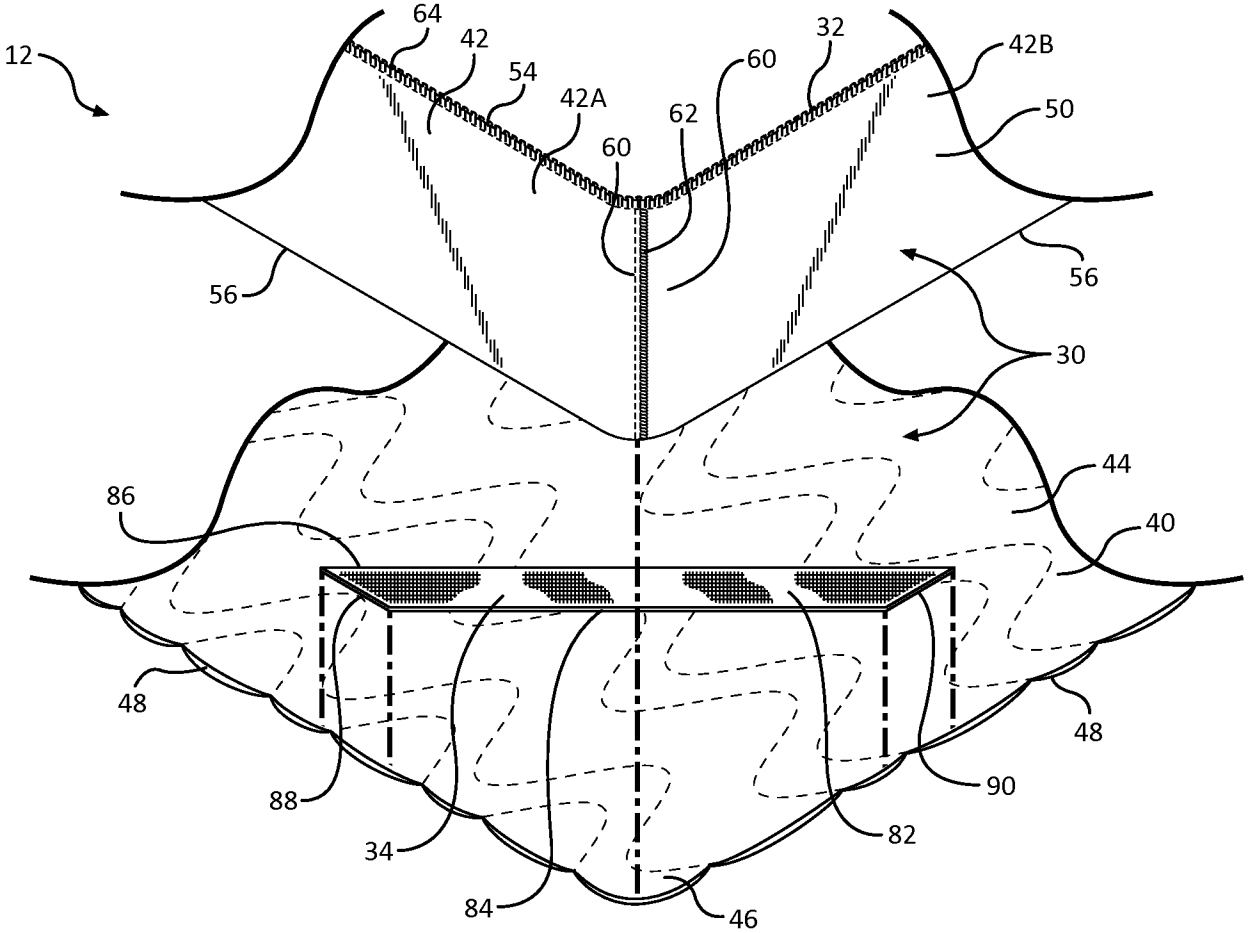
FIG. 7 is an exploded, perspective view illustration of a portion of a covered mattress system with components orientated for assembly, according to one embodiment of the present invention.
Figure 8:
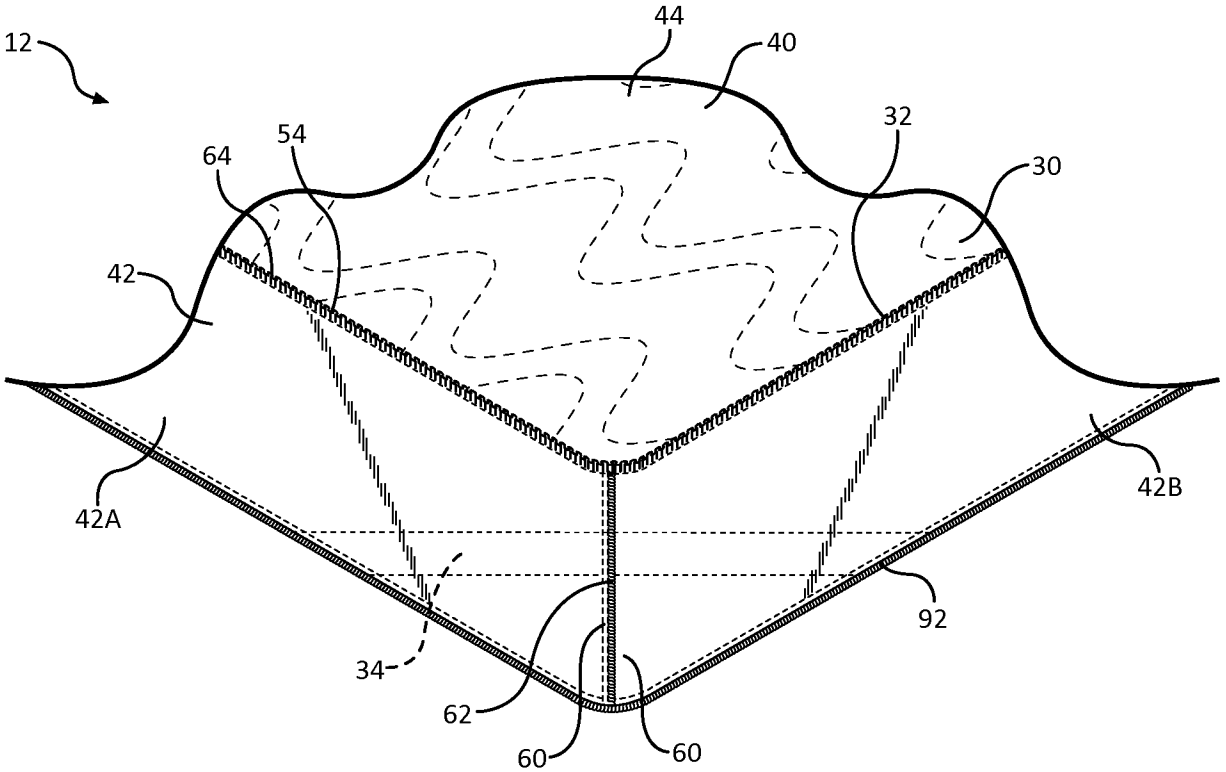
FIG. 8 is a perspective view of the components of FIG. 7 assembled to form the fitted covering of FIG. 1, according to one embodiment of the present invention.
Figure 9:
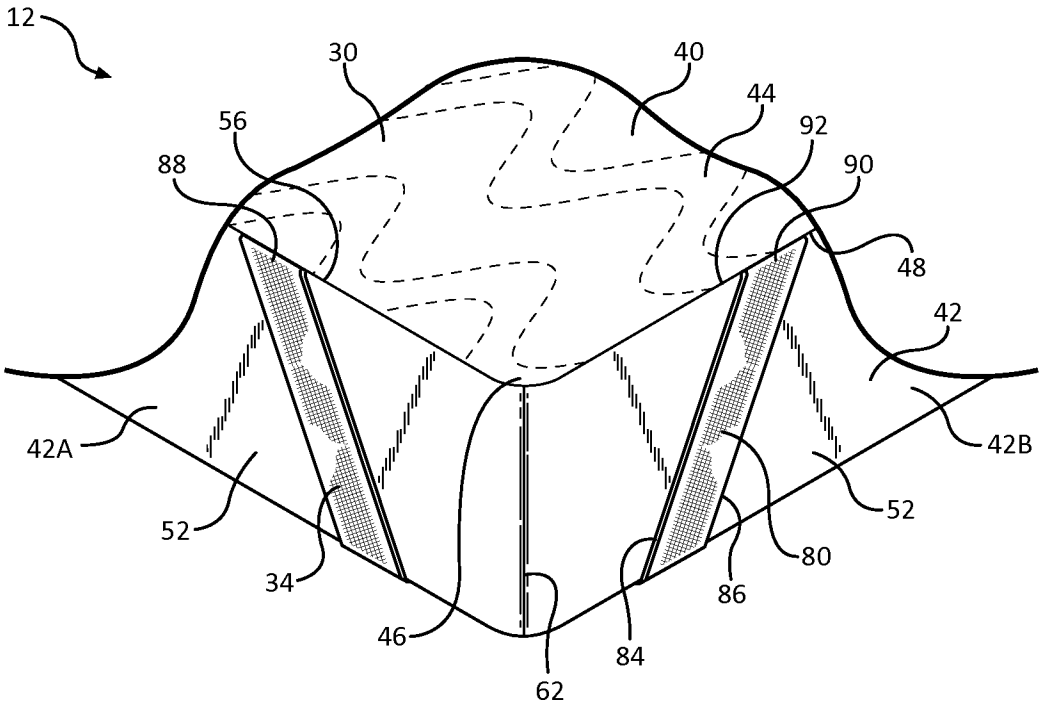
FIG. 9 is an enlarged, top, front perspective view of a corner portion of the covered mattress system of FIG. 1, according to one embodiment of the present invention.
Figure 10:
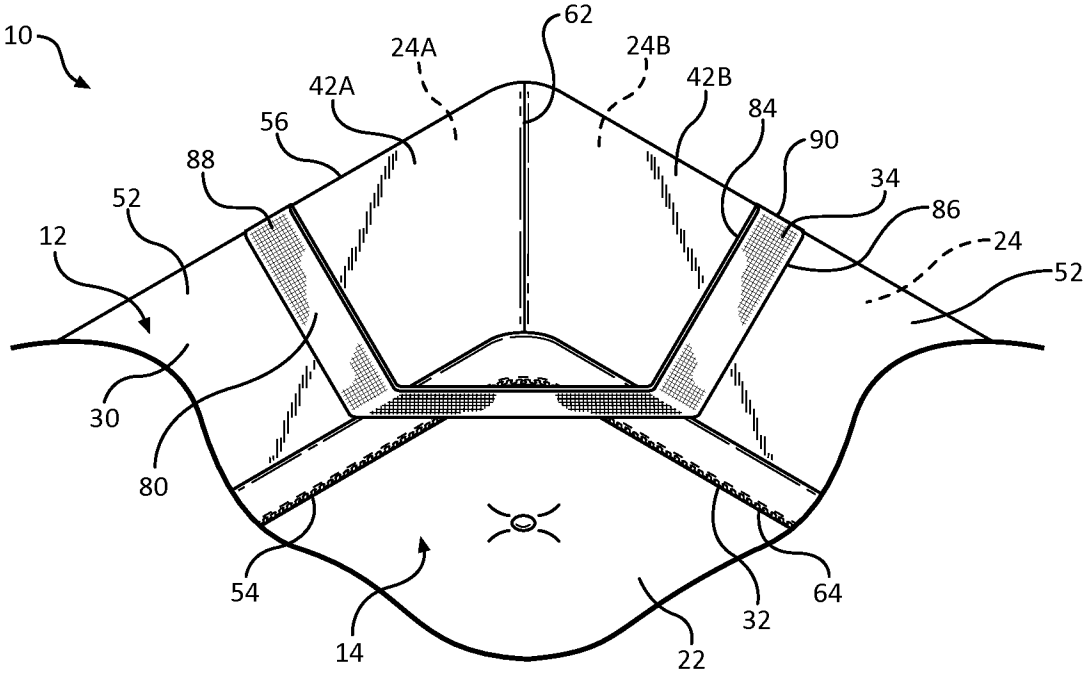
FIG. 10 is an enlarged, bottom, front perspective view of the corner portion of the covered mattress system of FIG. 9, according to one embodiment of the present invention.
Figure 11:
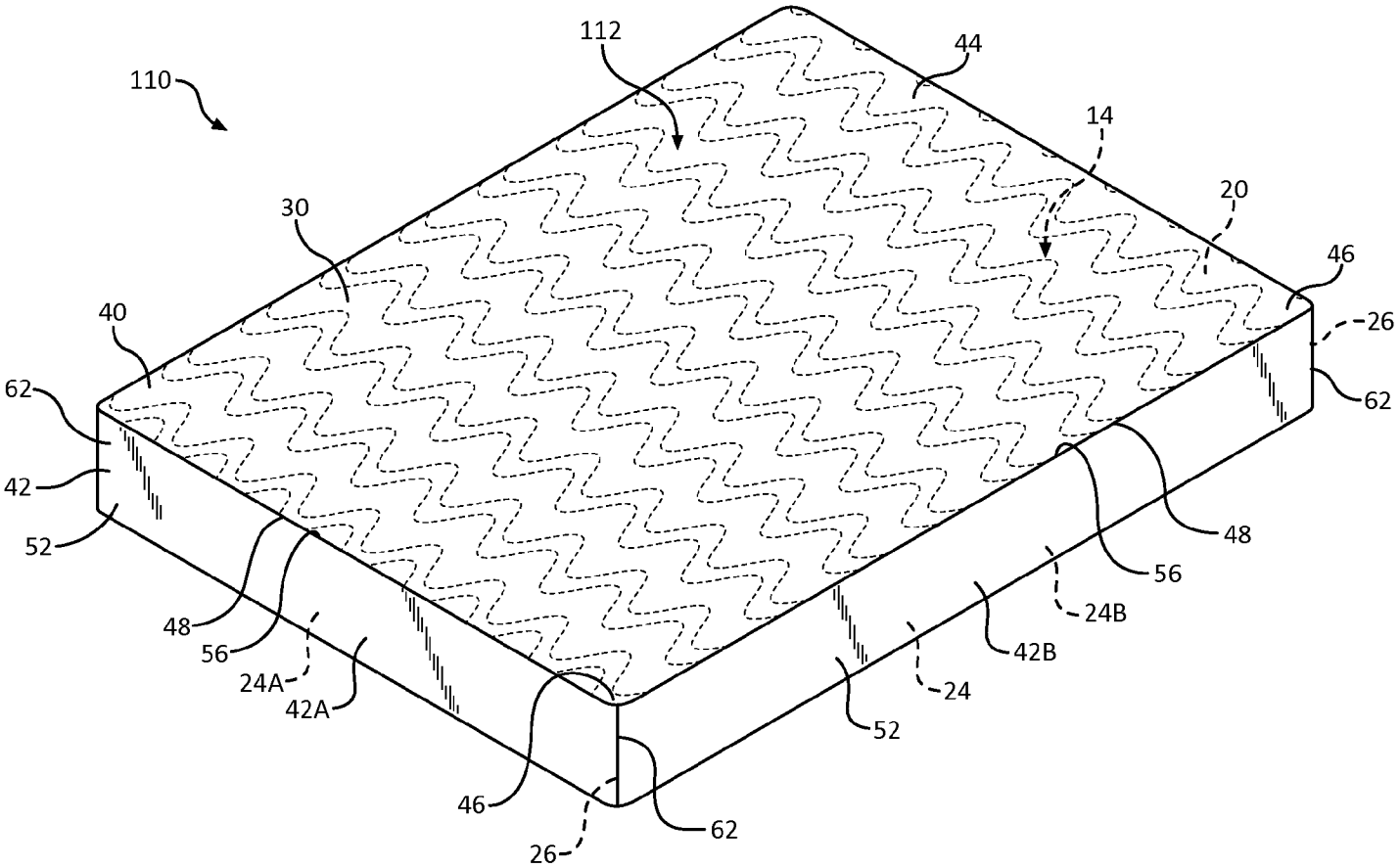
FIG. 11 is a top, front perspective view illustration of a covered mattress system including a mattress and a fitted covering, according to one embodiment of the present invention.
Figure 12:
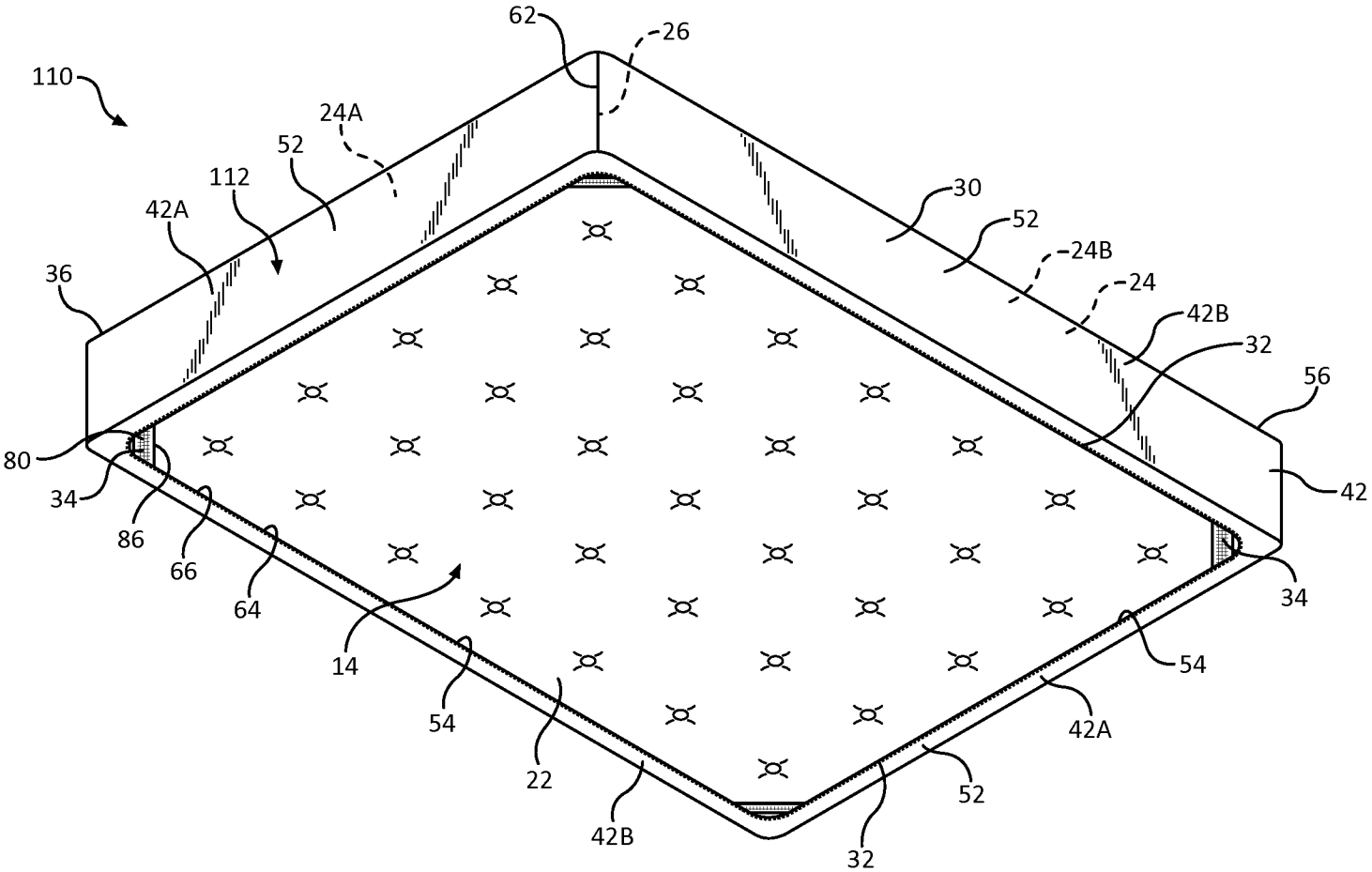
FIG. 12 is a bottom, front perspective view illustration of the covered mattress system of FIG. 11, according to one embodiment of the present invention.
Figure 13:
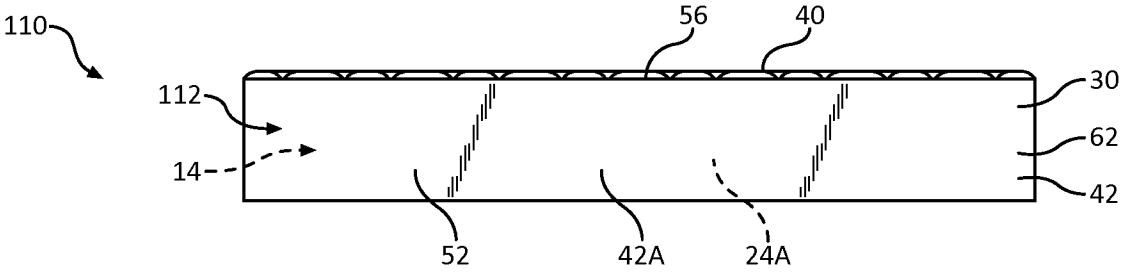
FIG. 13 is a front view illustration of the covered mattress system of FIG. 11, according to one embodiment of the present invention; the rear view being a mirror image of the front view.
Figure 14:
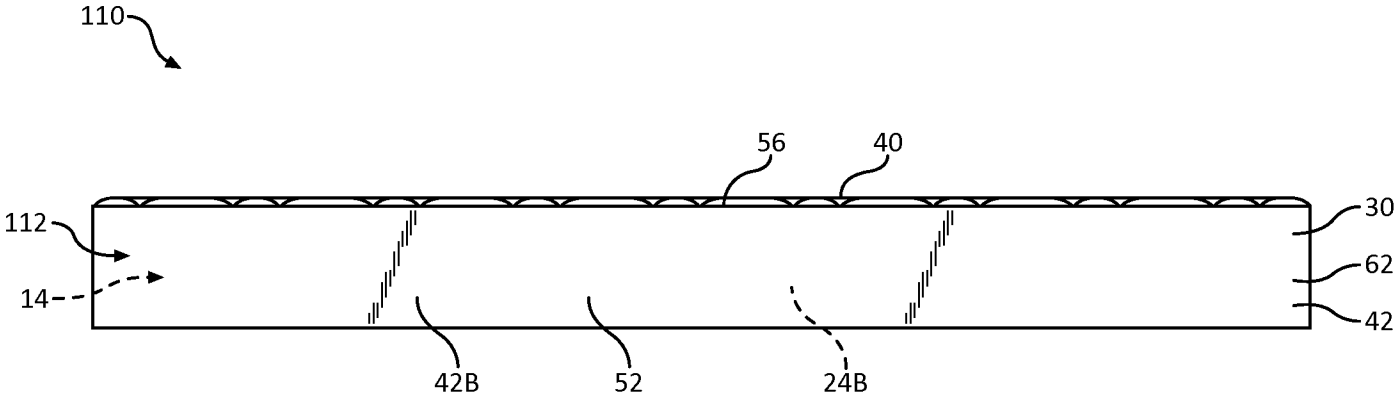
FIG. 14 is a right side view illustration of the covered mattress system of FIG. 11, according to one embodiment of the present invention; the left side view being a mirror image of the right side view.
Figure 15:
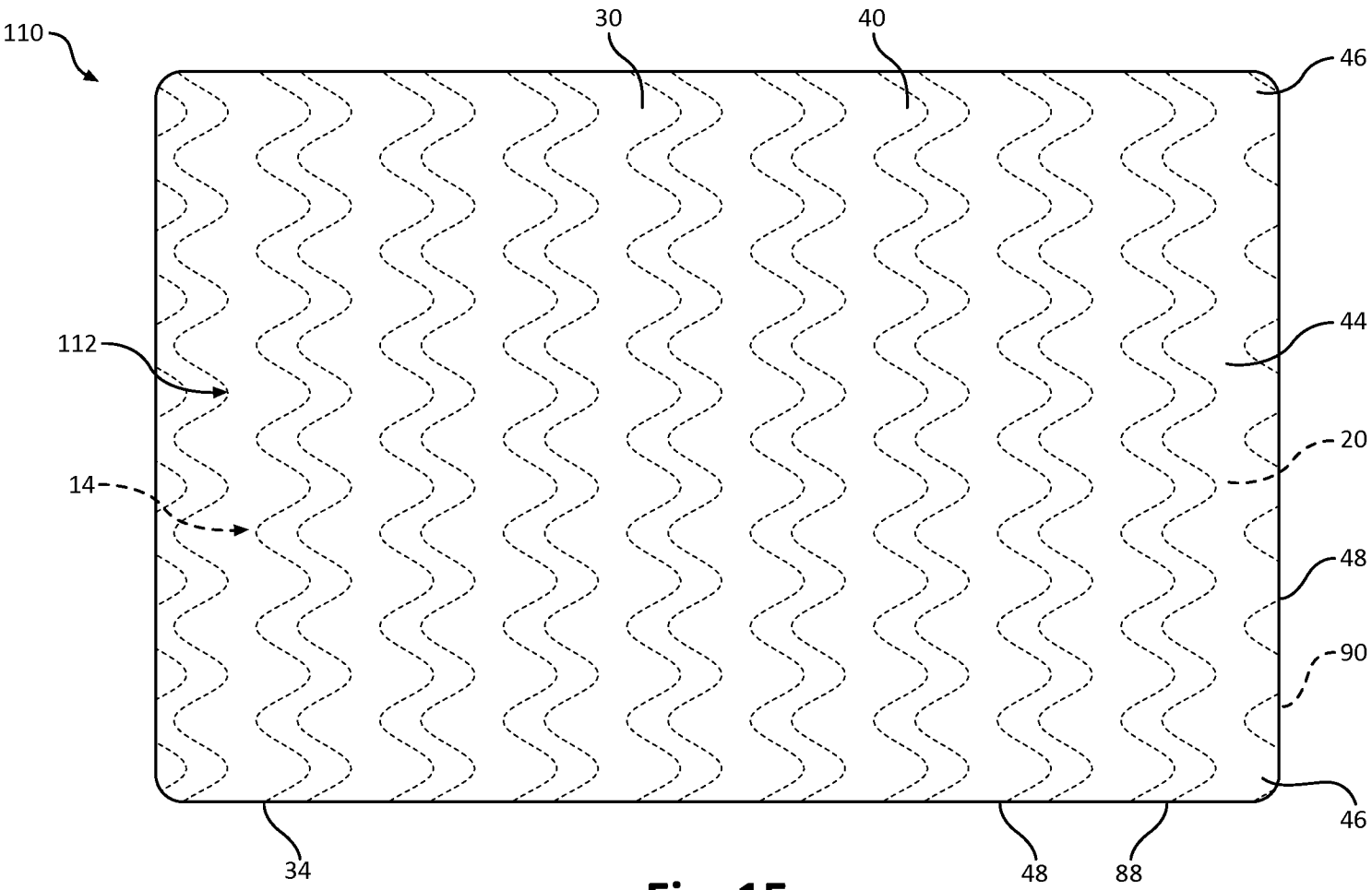
FIG. 15 is a top view illustration of the covered mattress system of FIG. 11, according to one embodiment of the present invention.
Figure 16:
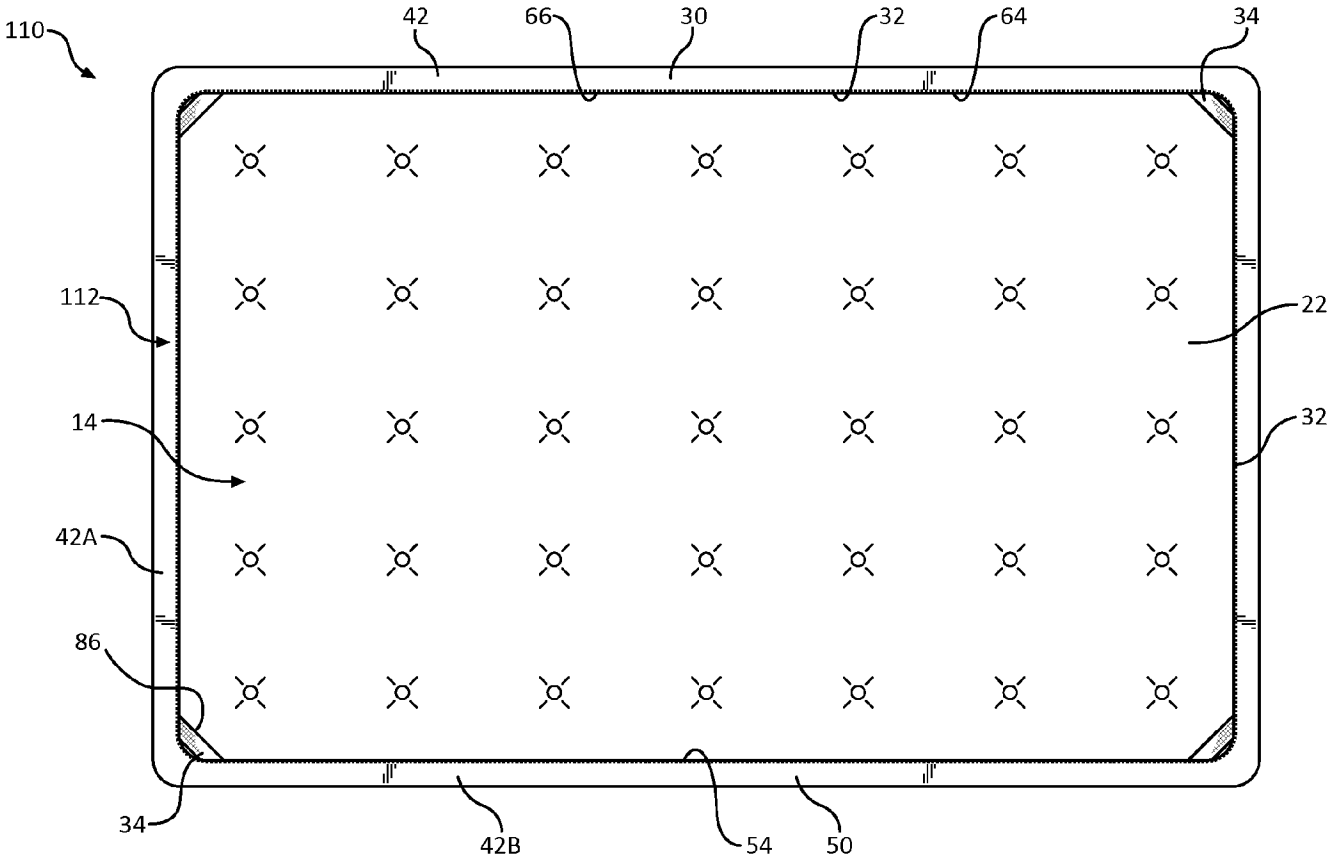
FIG. 16 is a bottom view illustration of the covered mattress system of FIG. 11, according to one embodiment of the present invention.

During construction of fitted covering 12, according to one embodiment of the invention, upper panel 40 is placed with exterior face 44 facing upwardly as illustrated in FIG. 7. One anchor band 34 is placed diagonally across each corner 46 of upper panel 40, e.g., at about a 45° angle relative to perimeter edges 48 with exterior face 80 facing toward upper panel 40 and interior face 82 facing upwardly therefrom. In this position, first short edge 88 and second short edge 90 are each substantially linear and are each located to align with a portion of a different one of perimeter edges 48 of upper panel 40.

In one example, lateral ends 60 of side panels 42 are secured to one another via seam 62 as illustrated or side panels 42 are provided as a single piece of material. Subsequently, side panel 42 is placed with exterior faces 52 turned downward facing upper panel 40 (i.e., with right sides together) and interior faces 50 turned upward. Top edges 56 are aligned with perimeter edges 48 and corner seam 62 is aligned with corner 46 of upper panel 40 such that all the top edges 56 of side panels 42 collectively extend about an entire periphery of perimeter edges 48. Additionally referring to the next step illustration of FIG. 8, side panels 42 are sewn to upper panel 40 via stitching or seam 92 along top edges 56 of side panels 42 and perimeter edges 48 of upper panel 40. In sewing seams 92, care is taken to capture portions of each anchor band 34 near first short end 88 and near second short end 90 within seam 92, thereby, securing anchor band 34 in place relative to each of upper panel 40 and side panels 42. In one example, additional stitching (not shown) may be applied across first short end 88 and/or second short end 90 of anchor band 34 to further fortify coupling of anchor band 34 to a remainder of body 30 of fitted covering 12. In one example, anchor bands 34 are only coupled to body 30 at first short end 88 and second short end 90 and freely extend therebetween. Peripheral elastic band 32 may be applied to bottom edges 54 of side panels 42 either one of before or after completing stitching 92.

Once seam 92 is stitched, side panels 42 are folded or rotated about seam 92 to extend substantially downwardly from perimeter edges 48 of upper panel 40 and such that exterior faces 52 of side panels 42 face outwardly and interior faces 50 of side panels 42 face toward each other during use or, when folded for transport and sale, face toward interior face (not shown) of upper panel 40. Each anchor band 34 is also flipped downwardly from its interface with seam 92 to extend downwardly along and under its corresponding, adjacent side panels 42.

Fitted covering 12 is placed on mattress 14 by first placing interior surface (not shown) of upper panel 40 adjacent to or at least toward upper face 20 of mattress such that the outer peripheries of each generally align with one another as illustrated, for example, in FIGS. 1-6. Side panels 42 are pulled downwardly away from upper panel 40 alongside side faces 24 of mattress 14 and wrap around mattress 14 to extend partially along a bottom surface of lower face 22 of mattress 14. Peripheral elastic band 32 pulls side faces 24 relatively taught along side faces 24. Once side panels 42 are in place, each of corner anchor bands 34 is stretched to extend downwardly from perimeter edges 48 of upper panel 40 and seam 92, along two respective side panels 42, and below lower face 22 of mattress 14 to provide additional securement of fitted covering 12 over mattress 14. The additional securement holds fitted covering 12 in more direct alignment with mattress 14 such that upper panel 40 remains more entirely aligned with upper face 20 of mattress 14 leading to less overall shifting of fitted covering 12 on mattress 14 and increasing sustained comfort by users of mattress 14 with fitted covering 12. In one example, a fitted sheet or other suitable sheet (not shown) is generally applied over fitted covering 12, such as where fitted covering 12 is a mattress pad. Other variations are also contemplated.

FIGS. 11-16 illustrate another embodiment of a fitted covering 112 on mattress 14 to collectively form a covered mattress system 110. Fitted covering 112 is substantially identical to fitted covering 12 described above and includes similar components as indicated by the common reference numbers shown in the figures differing only in the manners specifically described below. However, fitted covering 112 includes anchor band 34 secured inside side panels 42 of fitted covering 112, rather than outside side panels 42 as described for fitted covering 12 and illustrated in FIGS. 1-10. This arrangement is achieved during construction, for example, by changing the order of anchor band 34 and side panels 42 over upper panel 40. That is, rather than placing anchor band 34 and then side panels 42 over upper panel 40 as illustrated in FIG. 7, side panels 42 are first placed over upper panel 40 followed by anchor bands 34. The remainder of construction is as described for fitted covering 12. During use, anchor bands 34 are placed around mattress 14 before side panels 42, and otherwise use of fitted covering 112 is much the same as described above for fitted covering 12 as will be apparent to those of skill in the art upon reading this application. In this embodiment, anchor bands 34 are largely hidden from view. Other variations to fitted covering 12 and 112 are also contemplated.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A fitted covering for a mattress, the fitted covering comprising:

a body including an upper panel and a side skirt extending away from an outer perimeter of the upper panel, wherein:

the upper panel and the side skirt are coupled to one another along a seam extending substantially entirely around the outer perimeter of the upper panel, and the upper panel defines at least one corner;

a peripheral elastic band coupled with and extending around the side skirt opposite the upper panel; and an anchor band being elongated and defining a first end and a second end opposite the first end, the first end and the second end being positioned on opposite sides of the at least one corner such that the anchor band extends diagonally across the at least one corner, and each of the first end and the second end is secured within the seam.

2. The fitted covering of claim 1, wherein during use of the fitted covering on a mattress, each of the side skirt and the anchor band extend downwardly from the seam.

3. The fitted covering of claim 1, wherein:

the fitted covering is configured for use on a mattress including an upper face, a lower face opposite the upper face, and four side faces each extending between the upper face and the lower face, during use of the fitted covering on the mattress, the upper panel of the body is configured to be placed on the upper face of the mattress, and further during use of the fitted covering on the mattress, each of the side skirt and the anchor band is configured to extend down along at least two of the four side faces of the mattress and across a portion of the lower face of the mattress.

4. The fitted covering of claim 3, wherein the anchor band extends outside the side skirt such that during use of the fitted covering on the mattress, the anchor band is configured to extend down over the side skirt interposing a portion of the side skirt between the anchor band and the mattress.

5. The fitted covering of claim 3, wherein the anchor band extends inside the side skirt such that, during use of the fitted covering on the mattress, the side skirt is configured to extend over the anchor band interposing end portions of the anchor band between the side skirt and the mattress.

6. The fitted covering of claim 3, wherein during use of the fitted covering on the mattress, the anchor band is configured to extend from the seam down two adjacent ones of the four side faces of the mattress and diagonally across the mattress along the lower face of the mattress.

7. The fitted covering of claim 1, wherein the anchor band comprises an elongated strip of elastic.

8. The fitted covering of claim 1, wherein the anchor band comprises an elongated strip of elastic having a width of at least one inch.

9. The fitted covering of claim 1, wherein:

the upper panel defines four corners including the at least one corner, the anchor band is one of four anchor bands, and each of the four anchor bands extends across a different corner of the upper panel.

10. The fitted covering of claim 1, wherein:

the anchor band has a first elongated edge and a second elongated edge extending substantially parallel to the first elongated edge and positioned farther away from the at least one corner than the first elongated edge, and the anchor band includes opposing ends each extending from the first elongated edge angled away from the other opposing end to the second elongated edge such that the second elongated edge is longer than the first elongated edge.

11. The fitted covering of claim 1, wherein the upper panel is substantially rectangular and has a size corresponding with a standard mattress size.

12. The fitted covering of claim 1, wherein the anchor band is secured to each of the upper panel and the side skirt only at the seam.

13. The fitted covering of claim 1, in combination with a mattress, the mattress including:

an upper face, a lower face opposite the upper face, and side faces extending between the upper face and the lower face to define corners at the intersection of each side face with another one of the side faces, wherein:

the upper panel of the fitted covering extends over and substantially covers the upper face of the mattress, the side skirt extends from the seam down each side face of the mattress and covers an outer perimeter portion of the lower face of the mattress, and the anchor band extends from the seam down two adjacent side faces of the mattress and diagonally across a corner of the mattress along the lower face of the mattress.

14. The fitted covering of claim 1, wherein the fitted covering is one of a mattress pad and a fitted sheet.

15. A mattress covering for use on a mattress defining a top face, a bottom face positioned opposite the top face, and four side faces extending substantially perpendicularly relative to the top face, the mattress covering comprising:

a body including:

a top panel for covering the top face of the mattress, the top panel including a perimeter edge;

side panels each extending from the perimeter edge of the top panel to entirely cover the four side faces of the mattress and at least a portion of the bottom face of the mattress;

a closed-loop elastic band secured to edges of the side panels opposite the top panel; and an anchor band extending from the perimeter edge of the top panel, wherein during use of the mattress covering, the anchor band extends along each of two of the four side faces of the mattress and along the bottom face of the mattress to at least partially secure the mattress covering to the mattress.

16. The mattress covering of claim 15, wherein the two of the four side faces of the mattress are two adjacent ones of the four side faces, and the anchor band extends diagonally across a corner of the mattress formed at an intersection of the two adjacent ones of the four side faces.

17. The mattress covering of claim 15, wherein the anchor band is coupled with the mattress covering at two separate points only along the perimeter edge of the top panel.

18. The mattress covering of claim 17, wherein the side panels are coupled to the top panel around the perimeter edge of the top panel by a seam, and the anchor band is coupled with the mattress at the two separate points via the seam.

19. The mattress covering of claim 15, wherein the anchor band is one of four anchor bands included on the mattress covering and each of the four anchor bands is configured to extend under a different corner of the mattress.

20. The mattress covering of claim 15, wherein the anchor band extends from the perimeter edge of the top panel over two adjacent ones of the side panels and across a portion of the bottom face of the mattress between the two adjacent ones of the side panels such that portions of each of the two adjacent ones of the side panels are interposed between the anchor band and a different one of the four side faces of the mattress.

21. The mattress covering of claim 15, wherein two of the side panels each extends from the perimeter edge of the top panel over the anchor band such that portions the anchor band are interposed between the two of the side panels and two corresponding ones of the four side faces of the mattress.

22. A method of constructing a fitted covering for a mattress, the method comprising:

providing an upper panel formed of fabric and defining an outer perimeter edge and four corners;

positioning a top edge of a side skirt to align and coterminously extend with the outer perimeter edge of the upper panel;

positioning an elongated elastic band to extend between two points, each of the two points being located along the outer perimeter edge and being spaced on a different side of one of the four corners; and sewing a seam coupling the outer perimeter edge of the upper panel to the top edge of the side skirt, wherein sewing the seam includes capturing the elongated elastic band within the seam at each of the two points to secure the elongated elastic band to the upper panel and the side skirt, and the elongated elastic band freely extends between the two points.

23. The method of claim 22, wherein positioning the elongated elastic band includes positioning the elongated elastic band between the upper panel and the side skirt before sewing the seam such that during use of the fitted covering after sewing the seam, the elongated elastic band extends over the side skirt such that at least a portion of the side skirt is positioned between the elongated elastic band and the mattress.

24. The method of claim 22, wherein positioning the elongated elastic band includes positioning the elongated elastic band on a side of the side skirt opposite the upper panel before sewing the seam such that during use of the fitted covering after sewing the seam, the elongated elastic band extends between the side skirt and the mattress.

* * * * *